US005341869A

United States Patent [19]

Kidaloski et al.

[11] Patent Number: 5,341,869

[45] Date of Patent: Aug. 30, 1994

[54] TOP SUPPORTED HIGH TEMPERATURE HEATING SURFACE MODULE WITH PERMANENT STRUCTURAL FRAME

[75] Inventors: Raymond G. Kidaloski, Canal Fulton; Roger A. Detzel, Norton, both of Ohio

[73] Assignee: The Babcock & Wilcox Company, New Orleans, La.

[21] Appl. No.: 92,307

[22] Filed: Jul. 15, 1993

[51] Int. Cl.[5] ..... F22B 37/24

[52] U.S. Cl. ..... 165/67; 122/510

[58] Field of Search ..... 165/67, 68; 122/494, 122/510

[56] References Cited

U.S. PATENT DOCUMENTS

| | | | |
|---|---|---|---|
| 2,654,352 | 10/1953 | Schoenfeld | 122/494 |
| 3,479,994 | 11/1969 | Kreider et al. | 122/494 |
| 3,608,525 | 9/1971 | Sharan | 122/6 A |
| 4,008,691 | 2/1977 | Kreider et al. | 122/494 |

FOREIGN PATENT DOCUMENTS

| | | | |
|---|---|---|---|
| 724442 | 12/1965 | Canada | 122/510 |

*Primary Examiner*—Allen J. Flanigan

*Attorney, Agent, or Firm*—Robert J. Edwards; Eric Marich

[57] ABSTRACT

An arrangement for containing a top supported heating unit therein comprises a top and bottom opposite the top. Two vertical members are connected to the top and the bottom and the vertical members are spaced a distance from each other. At least one level is rotatably connected between the vertical members. A plurality of support rods are connected to the top and the level. Temporary supports are removably attached to the top, the vertical members and the bottom and the heating unit extends between the top and the bottom through the level and is confined by the vertical members and the support rods.

13 Claims, 6 Drawing Sheets

TOP SUPPORTED HIGH TEMPERATURE HEATING SURFACE MODULE WITH PERMANENT STRUCTURAL FRAME

FIELD AND BACKGROUND OF THE INVENTION

The present invention relates in general to heat exchangers and in particular to a new and useful modular arrangement for the shipment and assembly of heat exchanger units.

In recent years, Heat Recovery Steam Generators (HRSG's) have usually consisted of a vertically oriented heat exchanger comprising spirally-finned tubes located inside an externally supported box type structure. High temperature turbine exhaust gas passes through the box and over the tubes in order to recover the heat from the gas.

For economic reasons, it has been common practice to incorporate a modular type design which utilizes a shop fabricated and shop assembled heating surface arrangement. Larger HRSG's are generally two or more modules wide.

Known modular arrangements typically comprise a finned tube heating surface that is bundled complete with top and bottom headers. For ease of handling, these modular shop assembled packages are assembled with an integral shipping truss assembly built of commercially available structural steel shapes.

The finned tube heating surface is shipped in a horizontal position and rotated at the erection site to a vertical orientation. When in its final position, support for the heating surface is normally provided by base frame steel which comprises a part of the shipping truss assembly.

The known box type structure designs comprise internally insulated and lined casing panels which incorporate a cold casing design. These panels can be either a part of the shipping module or they can be installed after the HRSG pressure part modules have been placed in their final position. Column steel attached to these panels provides the overall strength and stability for the total HRSG structure by providing side to side as well as fore and aft restraint against potential loadings which could occur as a result of wind and seismic conditions.

SUMMARY OF THE INVENTION

The present invention provides for an arrangement for containing a heating unit therein which comprises a top and bottom opposite the top. Two vertical members are connected to the top and the bottom and are spaced a distance from each other. At least one level is rotatably connected between the vertical members. A plurality of support rods are connected to the top and the level. Temporary supports are removably attached to the top, the vertical members and the bottom. The heating unit extends between the top and the bottom through the level and is confined by the vertical members and the support rods.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

The present invention is an arrangement for the shipment and assembly of heat exchanger units for a heat recovery steam generator. The heating surfaces of the heat recovery steam generator are contained within a structural frame comprising a combination of permanent and temporary steel members.

Figures 5A, 5B, 5C:
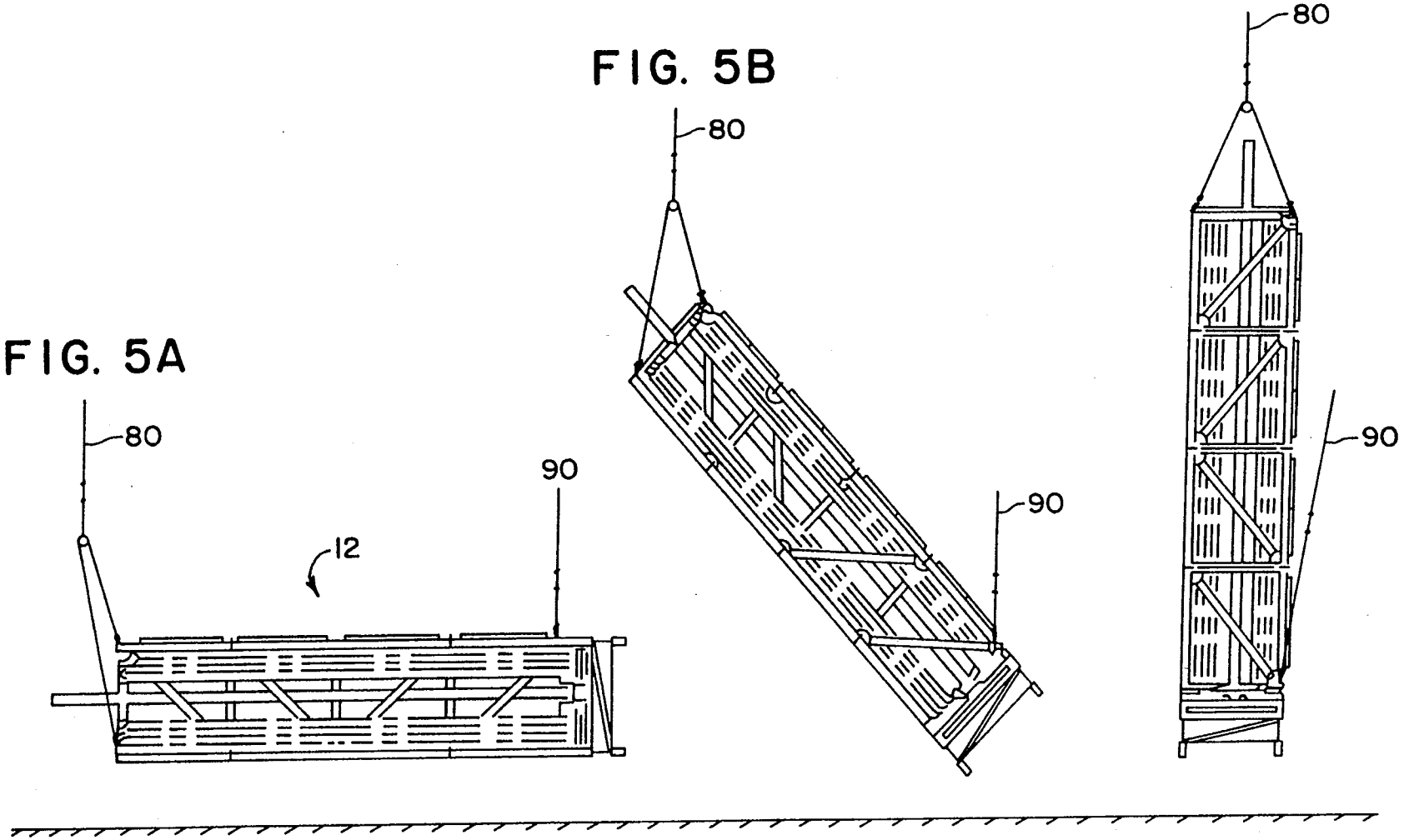
FIGS. 5*a*, are views illustrating the erection procedure of 5*b*, 5*c* the structure in FIG. 1.

As illustrated in FIGS. 5*a*, 5*b* and 5*c*, the present invention comprises a module 12 which is moved and handled in a horizontal position (FIG. 5*a*) and having a top lifting means 80 and a base lifting means 90. The present invention is lifted into a vertical position (FIG. 5*b*) for being set into its final position (FIG. 5*c*).

Figure 1:
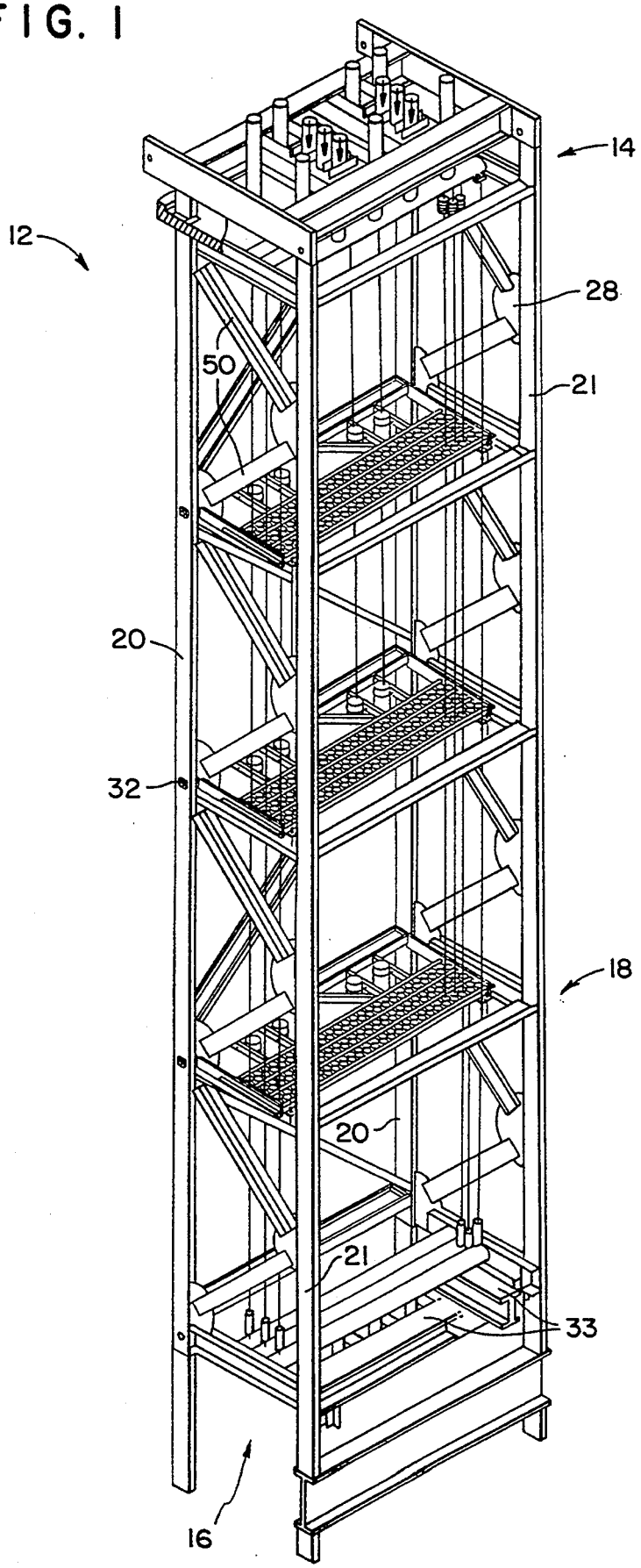
FIG. 1 is a perspective view of a module according to the present invention.

FIG. 1 shows the module 12 comprising permanent vertical members connected to a top 14 and a bottom 16. A plurality of levels 18 are rotatably connected to the permanent vertical members 20 by pins 32.

The module 12 also comprises temporary vertical frames 21 connected to the top 14 and the bottom 16 opposite the permanent vertical members 20. The temporary members 21 are removably attached to the top 14 and the bottom 16 once the module 12 is lifted into its final position (FIG. 5*c*).

The module 12 also comprises other temporary members for providing stability during shipment, handling and erection. These temporary members include a junction 28 removably attached to the permanent members 20 and the temporary members 21 and temporary diagonal truss members 50 connected to the junctions 28 between the levels 18. Temporary base members 33 are also used to stabilize the bottom 16 of the module 12 during shipment and handling.

Figure 2:
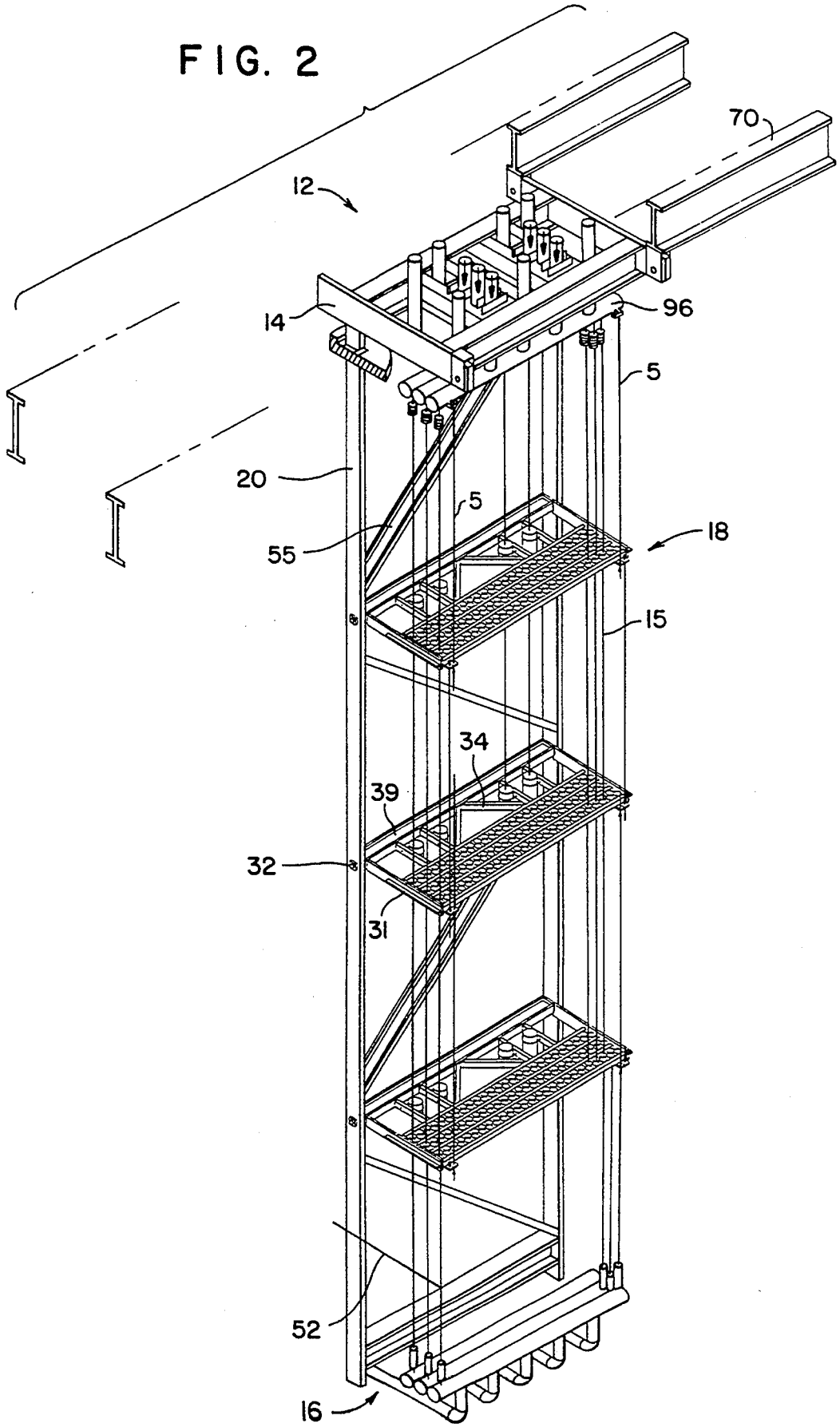
FIG. 2 is a view of FIG. 1 without temporary supports.

FIG. 2 shows the module 12 without its temporary supporting members. The module 12, at its final erection site (FIG. 5*c*), is attached to top steel 70 at the top 14 of the module 12. The module 12 also includes permanent diagonal members 55 connected between the permanent vertical members 20 and between each level 18 of the module 12. The top 14 comprises top headers 96. A plurality of support rods 5 are connected to the top 14 at the headers 96 and are connected to each level 18 of the module 12.

Figure 4:
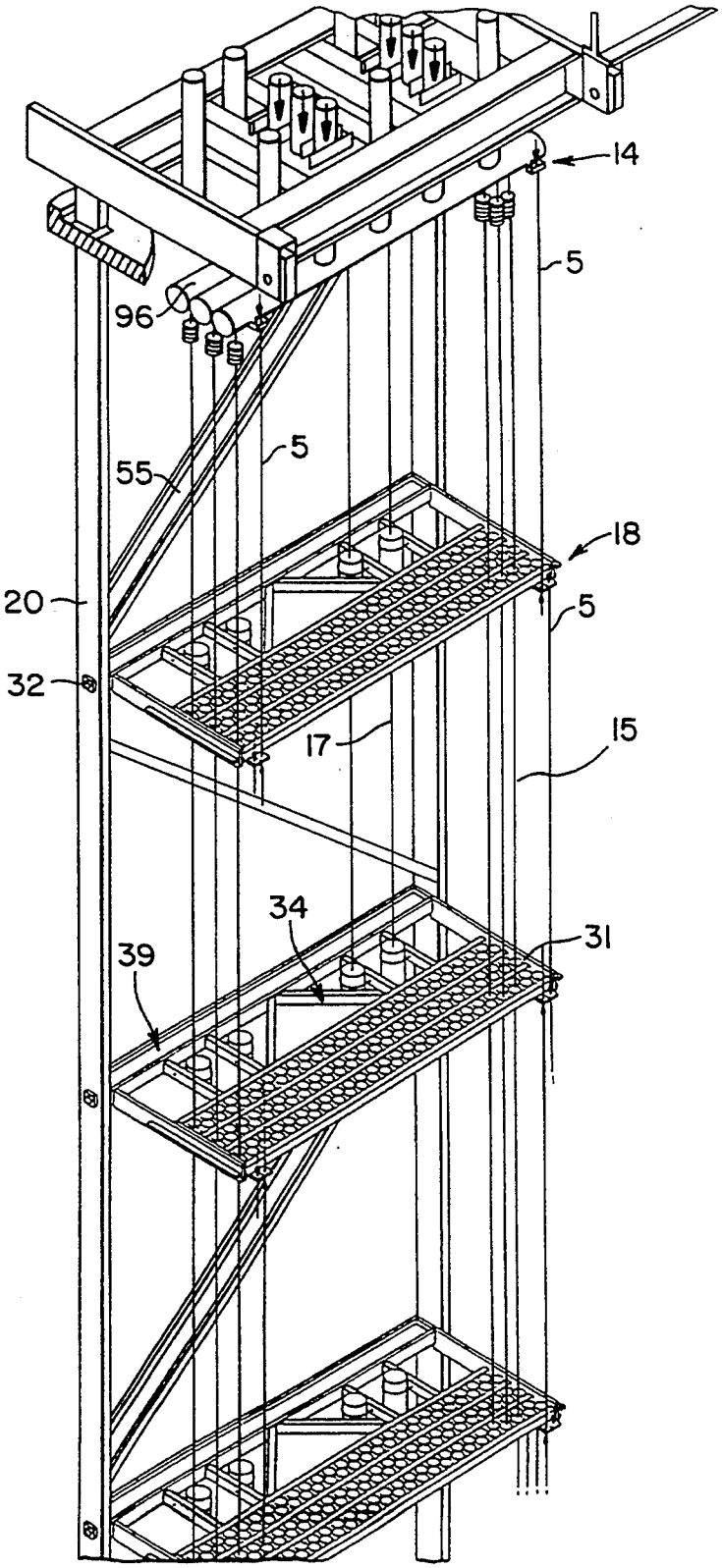
FIG. 4 is a view illustrating a section of FIG. 1.

The heating surfaces, i.e. spiral-finned tubes 15, extend through each level 18 from the top 14 to the bottom 16. A plurality of intermediate tubes 17 also extend through each level 18 from the top 14 to the bottom 16 as shown in FIG. 4.

Figure 6:
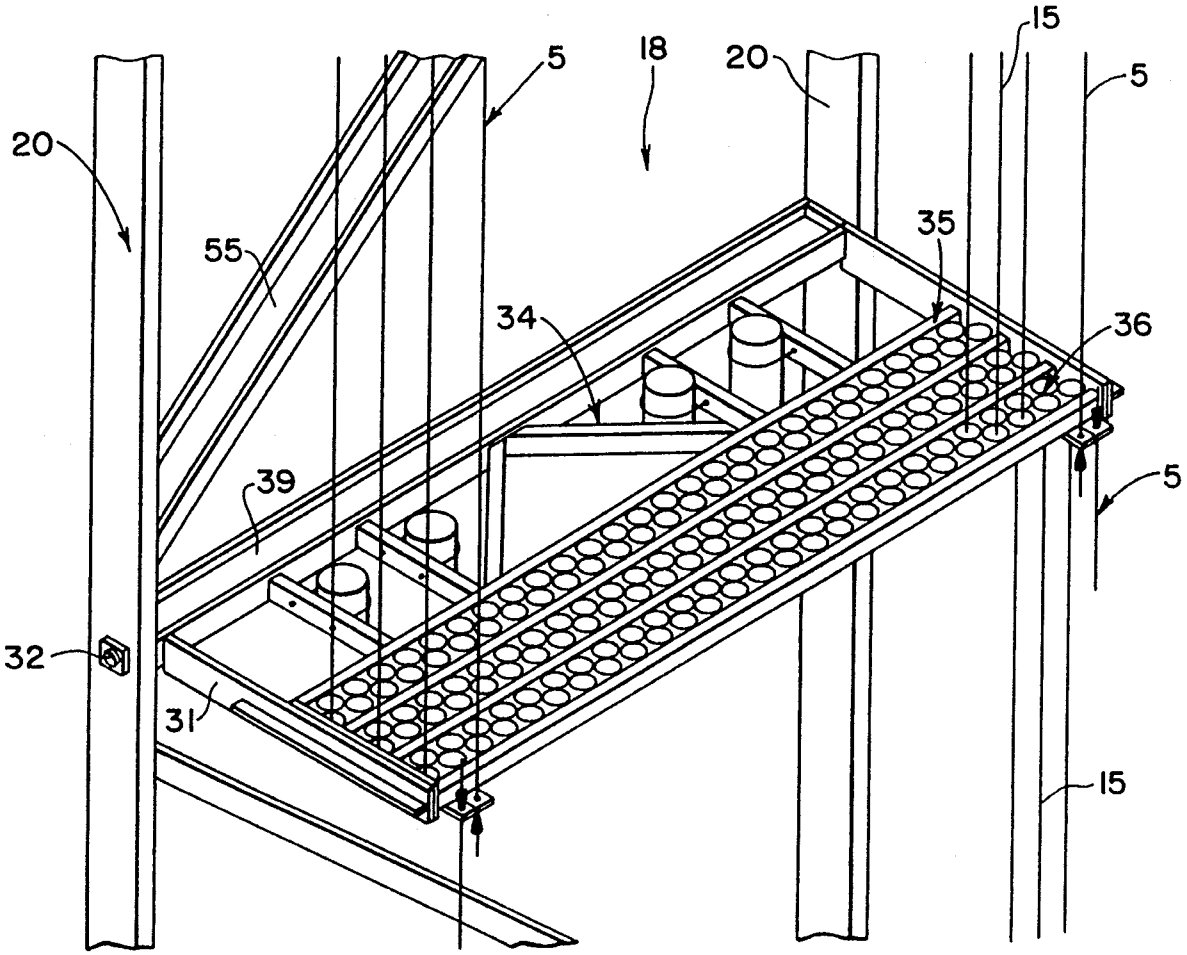
FIG. 6 is a view illustrating a level of FIG. 1.

FIG. 6 illustrates a level 18 rotatably attached by pins 32 to the permanent vertical members 20. Each level 18 comprises a structural beam 39 rotatably connected to the vertical members 20 and intermediate bracing 31 rotatably connected to the vertical members 20 and the structural beam 39. The intermediate bracing 31 also includes a plurality of rectangular tubes 35 and serpentine bars 36 between the rectangular tubes 35. The spiral-finned heating tubes 15 are arranged through the level 18 between the rectangular tubes 35 and against the serpentine bar 36. The level 18 also includes a diagonal internal truss 34 connected to the structural beam 39 and the intermediate bracing 31.

Figure 3:
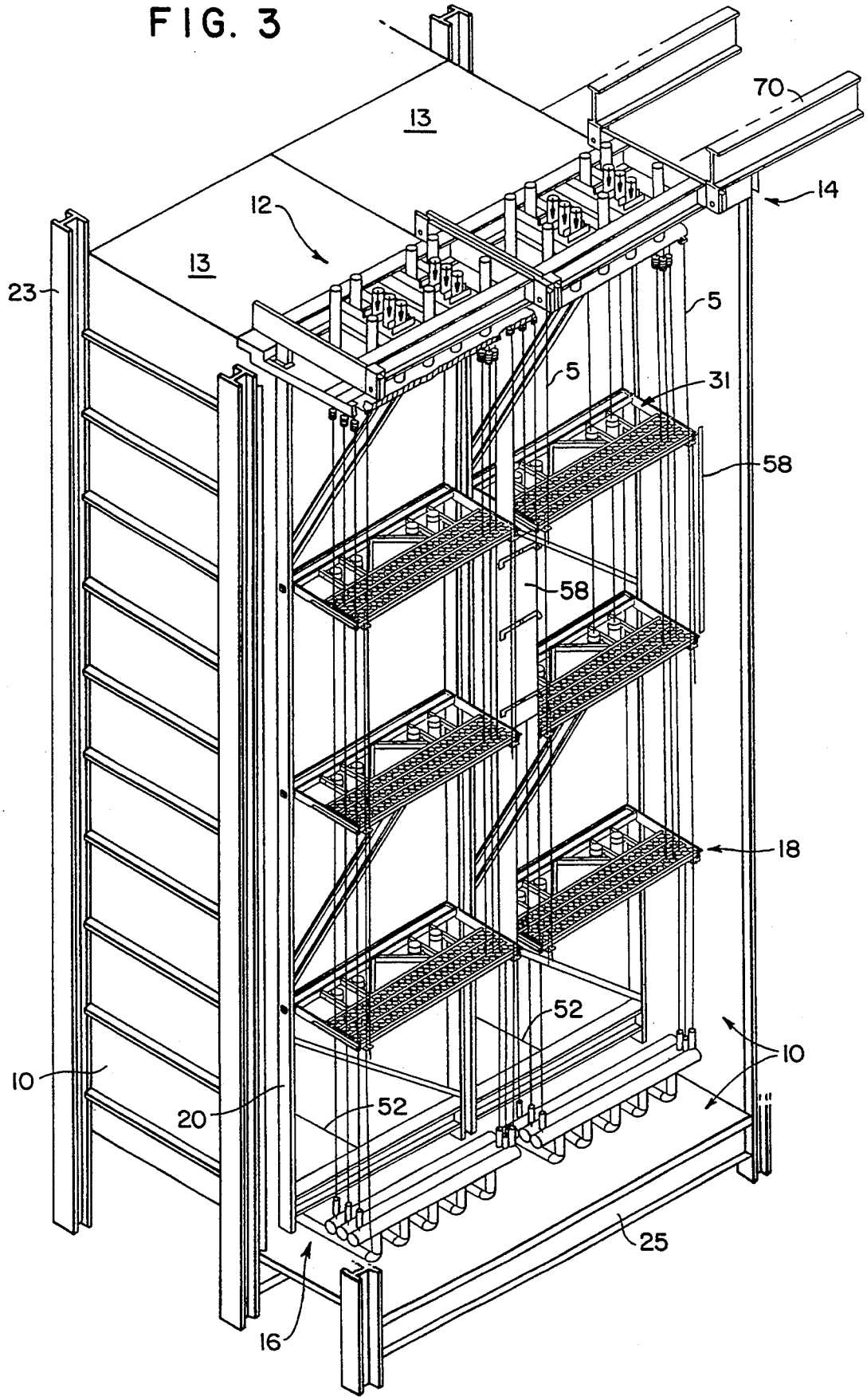
FIG. 3 is a view illustrating the module of FIG. 1 positioned in a permanent arrangement.

As illustrated in FIG. 3, the modules 12 are arranged adjacent each other within a casing 10 supported by main vertical columns 23 and a main base 25. A fore and aft tie 52 is provided from adjacent bottom supported modules 13, to provide lateral restraint to the top supported module 12 in the direction of gas flow through the modules 12, 13. Additionally, barriers 58 are attached between the modules 12 at the intermediate bracing 31 in order to block gas lanes or passages between the modules 12.

As shown in FIGS. 1, 2, 4 and 6, the pins 32 permit the levels 18 to rotate due to vertical differential thermal expansions between the front and the rear of the module 12. The diagonal truss members 34 are formed integral with the intermediate bracing 31 in order to provide side-to-side stabilization for the module 12 as shown in FIG. 6.

The module 12, according to the present invention, restrains the heating sections 15 laterally at the intermediate locations 18 by holding the heating sections 15 in place in order to prevent excessive vibration during operation.

The present invention allows for the heating surface to be packaged in a structural container which enables shipping and handling in a horizontal position and uprighting of the module 12 to a vertical position. The module 12 is independent and free standing and thus is easy to erect and transition from the bottom support to the top support. The modules 12 are set into place before side casings 10 or top steel 70, as shown in FIG. 3, are set in place which simplifies erection of the module 12. The remaining permanent steel, which is part of the shipping frame, is used to secure the fore and aft ties 52 (FIGS. 2 and 3) and miscellaneous attachments which are necessary for operation.

While a specific embodiment of the invention has been shown and described in detail to illustrate the application of the principles of the invention, it will be understood that the invention may be embodied otherwise without departing from such principles.

What is claimed is:

1. An arrangement for containing a top supported heating unit therein, the arrangement comprising:

a top;

a bottom opposite the top;

two vertical members connected to the top and the bottom, the vertical members spaced a distance from each other;

at least one level rotatably connected between the vertical members;

a plurality of support rods connected to the top and the level; and temporary support means removably attached to the top, the vertical members and the bottom, the heating unit extending between the top and the bottom through the level and confined by the vertical members and the support rods.

2. The arrangement according to claim 1, including a pin connected to each vertical member and the level.

3. The arrangement according to claim 2, including a plurality of levels connected between the vertical members, the levels spaced a distance apart from each other along the vertical members.

4. The arrangement according to claim 3, including a diagonal member connected between the vertical members between each level and extending diagonally between each level.

5. The arrangement according to claim 1, wherein the level comprises a structural beam rotatably connected between the vertical members.

6. The arrangement according to claim 5, wherein the level further comprises intermediate bracing rotatably connected to the vertical members and the structural beam.

7. The arrangement according to claim 6, wherein the intermediate bracing comprises a plurality of rectangular tubes.

8. The arrangement according to claim 7, wherein the intermediate bracing further comprises a serpentine bar between the rectangular tubes.

9. The arrangement according to claim 7, wherein the level further comprises a diagonal truss connected between the structural beam and the rectangular tubes.

10. The arrangement according to claim 1, wherein the temporary support means comprises two temporary vertical frames removably connected between the top and the bottom and positioned opposite of the two vertical members.

11. The arrangement according to claim 10, wherein the temporary support means further comprises a temporary support base removably connected to the bottom.

12. The arrangement according to claim 11, wherein the temporary support means further comprises a plurality of temporary members connected to the vertical members and the temporary vertical frames.

13. The arrangement of claim 1, including an adjacent bottom supported module, and a fore and aft tie provided therefrom to the bottom of the top supported heating unit to provide lateral restraint to the top supported heating unit.

* * * * *